United States Patent [19]

Stigsson

[11] Patent Number: 4,602,970

[45] Date of Patent: Jul. 29, 1986

[54] METHOD OF STABILIZING EMULSION EXPLOSIVES

[75] Inventor: Lars L. Stigsson, Lund, Sweden

[73] Assignee: Scan Coin S/A, Geneva, Switzerland

[21] Appl. No.: 679,761

[22] Filed: Dec. 10, 1984

[51] Int. Cl.[4] ..... D03D 23/00

[52] U.S. Cl. ..... 149/108.8; 149/2; 149/21; 149/46; 149/60; 149/70; 149/85; 149/109.6; 252/356; 526/911

[58] Field of Search ..... 149/2, 21, 109.6, 108.8, 149/96, 60, 70, 85; 252/356; 526/911

[56] References Cited

U.S. PATENT DOCUMENTS

| | | | |
|---|---|---|---|
| 3,914,140 | 10/1975 | Huskins | 149/19.9 |
| 3,914,206 | 10/1975 | Huskins | 149/19.9 |
| 4,110,134 | 8/1978 | Wade | 149/2 |
| 4,391,659 | 7/1983 | Smith | 149/2 |
| 4,420,349 | 12/1983 | Bampfield | 149/2 |

FOREIGN PATENT DOCUMENTS

| | | |
|---|---|---|
| 0018085 | 10/1980 | European Pat. Off. . |
| 2951905 | 2/1981 | Fed. Rep. of Germany . |
| 2007206 | 5/1979 | United Kingdom . |

*Primary Examiner*—Stephen J. Lechert, Jr.
*Attorney, Agent, or Firm*—Merchant, Gould, Smith, Edell, Welter & Schmidt

[57] ABSTRACT

Method of stabilizing an emulsion explosive comprising an oxidant, a fuel, and an emulsifier the molecules of which have at least one double-binding. The oxidant is emulsified in the fuel in the presence of the emulsifier, and a polymerizing reaction is effected after the emulsification to bind the molecules of the emulsifier chemically to each other.

9 Claims, 2 Drawing Figures

METHOD OF STABILIZING EMULSION EXPLOSIVES

The present invention relates to a method of stabilizing so-called emulsion explosives.

The primary object of the invention is to provide a method by which there is imparted to the explosive an increased stability against phase separation.

This and other objects which will be apparent from the description which follows, are achieved according to the invention by a method comprising an oxidant, a fuel, and an emulsifier the molecules of which have at least one double bond, wherein the oxidant is emulsified in the fuel in the presence of the emulsifier and a polymerizing reaction is effected after the emulsification to bind the molecules of the emulsifier chemically to each other.

Figure 1:
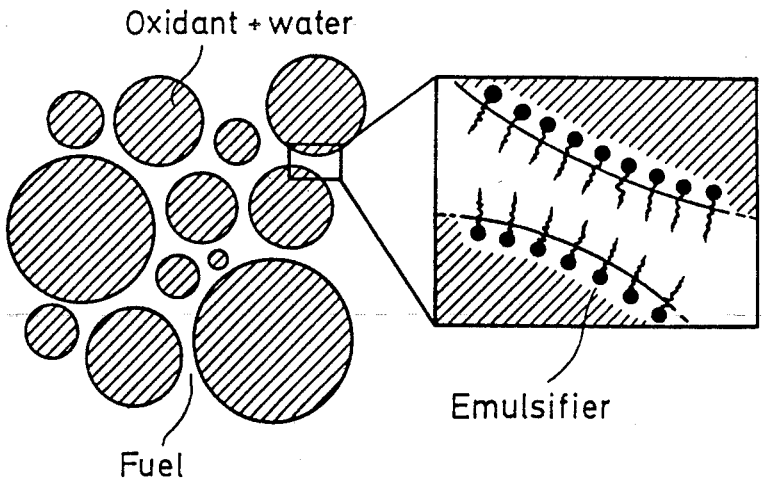
Figure 2:
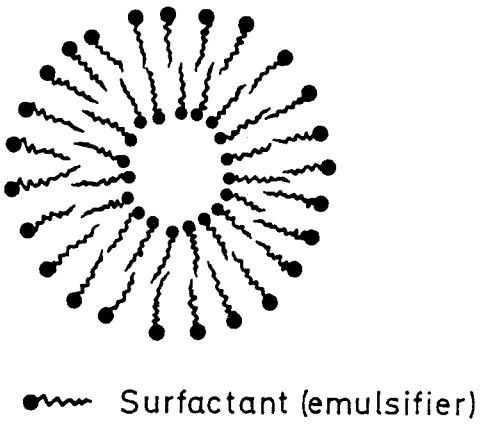

In order to explain the invention in more detail the structure of an emulsion explosive will be described briefly below and then the method of the invention comprising polymerization of the emulsifier will be described, reference being made to the accompanying drawing in which FIG. 1 shows diagrammatically the structure of an emulsion explosive, and FIG. 2 shows diagrammatically a vesicle.

An emulsion explosive comprises an oxidant and a fuel. The oxidant, usually ammonium nitrate ($NH_4NO_3$), shall supply oxygen atoms to the fuel usually comprising hydrocarbon compounds, such that the fuel can be oxidized to carbon dioxide ($CO_2$) and water ($H_2O$) under intense development of energy. An idealized reaction formula wherein the fuel is assumed to be dodecane, can be written as follows:

$$37NH_4NO_3+CH_3(CH_2)_{10}CH_3\rightarrow 37N_2+12CO_2+87H_2O+\text{energy}$$

As can be seen from the formula above, the weight ratio of ammonium nitrate and dodecane must be at least 17.4 in order to obtain a complete oxidization of the fuel. Moreover, the contact surface between the nitrate and the hydrocarbon must be as large as possible in order that the explosive will function optimally.

Since the ammonium nitrate does not dissolve in hydrocarbons but is highly soluble in water, the large contact surface will be obtained by emulsifying an ammonium nitrate solution in the hydrocarbon. The emulsification is effected by means of surfactants (emulsifiers) of one or several types and by supplying energy during intense stirring. The structure obtained of an emulsion explosive can be described as a highly concentrated ammonium nitrate solution dispersed in the form of droplets having a diameter ranging from 0.01 to 10 μm, in a hydrocarbon with the emulsifier in the interface between the solution and the hydrocarbon, which is shown diagrammatically in FIG. 1.

By definition an emulsion is instable and sooner or later will separate into two or more phases. For an emulsion explosive this results in an ammonium nitrate solution with a layer of hydrocarbon on top thereof. The period for phase separation can be long (perhaps one or more years at best), but will be influenced by small variations in the conditions of emulsification. Therefore, it is highly desired to increase deliberately the stability of an emulsion explosive. The method of the invention providing an increased stability against phase separation by chemical modification of the emulsifier will be described below.

The mechanism behind the phase separation in an emulsion would be that the dispersed droplets aggregate, coalesce, to form larger drops. As far as the emulsifier molecules are concerned, the effect of the coalescence is that the molecules diffuse from the contact position between two droplets, because the interface between the solution and the hydrocarbon will disappear. If this diffusion can be obstructed e.g. by binding the emulsifier molecules chemically to each other, the coalescence will be considerably obstructed, an increased stability being obtained as a consequence thereof. Thus, the problem is to find emulsifiers which can be bound to each other, and also to effect the reaction. Both problems are involved in the present invention.

It is known since several years that so-called vesicles can be polymerized. Vesicles differ from emulsions so far as the vesicles have the same type of phase (e.g. water solution) outside as well as inside the droplets. The surface-active molecules as far as vesicles are concerned have formed a so-called double-layer, which is illustrated in FIG. 2. In several papers, J. Fendler and his collaborators have described the stabilization of vesicles by polymerization of the surface-active molecules. In Fendler's works, surfactants (surface-active substances) and reaction routes are described. The present invention is based on these works and extends the method to emulsion explosives.

Briefly described, the polymerization is effected by the surfactant (emulsifier) which must contain at least one double-bond, being induced to form bonds with adjacent molecules in the double-layer (interface) by chemical or photochemical initiation. E.g. azoisobutyronitrile (AIBN) can be used as a chemical initiator, and the photochemical energy can be generated by a 450 W Xenon lamp or by means of a laser. In this connection, the easiest procedure would be to use a chemical initiator.

The requirement that the emulsifier molecules shall contain at least one double-binding is satisfied e.g. by one of the more common emulsifiers used today in emulsion explosives, viz. sorbitanmonooleat (SPAN 80). However, the possibilities of variation are large, and there are great possibilities of finding emulsifiers which are better suited for the purpose described.

The invention is illustrated by the following example.

EXAMPLE

The following example describes the polymerization method applied to a conventional emulsion explosive (reference is made to the paper "Moderna sprängämnen: Inte bara nitroglycerin" by A. Wetterholm, Kemisk Tidskrift, No. 1, 1983). Such an explosive has the following structure

| System | Substance | % by weight |
|---|---|---|
| I | Wax | 3.0 |
| | Oil | 1.0 |
| | Emulsifier | 1.0 |
| | Initiator | <0.1 |
| II | Ammonium nitrate | 67.5 |
| | Sodium nitrate | 3.0 |
| | Sodium perchlorate | 10.4 |
| | Water | 12.0 |
| III | Microspheres | 2.0 |

The emulsifier or emulsifier mixture in the example must contain molecules having at least one double-bond. Such emulsifiers include those having one or more olelyl groups, such as sorbitan monooleate (SPAN 80) and dioleylphosphateidylcholine ("lecithin"). The difference between a conventional emulsion explosive and the emulsion explosive of the example above is the addition of an initiator. This initiator can comprise azoisobutyronitrile which starts to form radicals at the temperatures normally used in the manufacture of emulsion explosives. The procedure of manufacture is described inter alia in U.S. Pat. No. 4,110,134 (C. G. Wade) example 1, but in this case the initiator is added to the fuel mixture (system I above).

I claim:

1. A method of stabilizing an emulsion explosive comprising an oxidant, a fuel and an emulsifier the molecules of which have at least one double bond, comprising:

(a) emulsifying an aqueous solution of the oxidant in a mixture of the fuel and the emulsifier; and (b) polymerizing the emulsifier to chemically bind the molecules of the emulsifier to each other so that the coalescence of the emulsified oxidant is obstructed.

2. The method of claim 1 wherein the emulsifier molecules contain one or more olelyl groups.

3. The method of claim 2 wherein the emulsifier comprises sorbitan monooleate.

4. The method of claim 1 wherein the oxidant comprises ammonium nitrate.

5. The method of claim 1 wherein the fuel comprises a hydrocarbon compound.

6. The method of claim 1 wherein the polymerization is initiated chemically.

7. The method of claim 6 wherein the initiator is combined with the fuel-emulsifier mixture.

8. The method of claim 6 wherein the initiator comprises azoisobutyronitrile.

9. The method of claim 1 wherein the polymerization is initiated photochemically.

* * * * *